US006572093B1

(12) United States Patent
Scholta

(10) Patent No.: US 6,572,093 B1
(45) Date of Patent: Jun. 3, 2003

(54) GATHER-STITCHER MACHINE AND METHOD FOR PRODUCING A HEADER INDEX FOR PRINT MATERIALS OF PAPERS WHICH ARE FILED BY MEANS OF A GATHER-STITCHER MACHINE

(75) Inventor: Friedrich Scholta, Köln (DE)

(73) Assignee: Heinrich Bauer Verlag, Hamburg (DE)

( * ) Notice: Subject to any disclaimer, the term of this patent is extended or adjusted under 35 U.S.C. 154(b) by 0 days.

(21) Appl. No.: 09/869,210

(22) PCT Filed: Dec. 23, 1999

(86) PCT No.: PCT/EP99/10339

§ 371 (c)(1),
(2), (4) Date: Jun. 22, 2001

(87) PCT Pub. No.: WO00/40425

PCT Pub. Date: Jul. 13, 2000

(30) Foreign Application Priority Data

Jan. 5, 1999 (DE) ..... 199 00 149

(51) Int. Cl.[7] ..... B42B 4/00

(52) U.S. Cl. ..... 270/52.17; 270/52.27; 412/16; 83/934; 83/155

(58) Field of Search ..... 270/52.17, 52.27, 270/52.29; 83/934, 90, 91, 92, 92.1, 155; 412/16

(56) References Cited

U.S. PATENT DOCUMENTS 4,072,076 A * 2/1978 Miles ..... 83/300
4,466,603 A * 8/1984 Schnell ..... 270/21.1
4,576,369 A * 3/1986 Flensburg et al. ..... 198/644
5,028,193 A * 7/1991 Misicka ..... 412/37
5,158,273 A * 10/1992 Wagner ..... 270/52.17
5,492,315 A * 2/1996 Maruyama et al. ..... 270/58.32
6,361,639 B1 * 3/2002 Owen et al. ..... 156/211

FOREIGN PATENT DOCUMENTS

EP 0 761 472 A 3/1997
JP 6-40182 * 2/1994
JP 2000-6087 * 1/2000

OTHER PUBLICATIONS

International Search Report, dated Jun. 5, 2000.

* cited by examiner

*Primary Examiner*—Christopher P. Ellis
*Assistant Examiner*—Patrick Mackey
(74) *Attorney, Agent, or Firm*—Fay, Sharpe, Fagan, Minnich & McKee

(57) ABSTRACT

Gather-stitcher machine for joining and stapling a plurality of stacks of sheets of a magazine, and method for producing a thumb-tab index on magazines to be stapled by means of the gather-stitcher machine. In order to make it possible for a thumb-tab index to be machine-produced on the magazine which has been assembled together by the gather-stitcher machine, the machine is equipped with at least edge punching device arranged to the rear of a feeder guide mechanism in the transport mechanism's direction of travel, which device only produces punched-out portions in said stack of sheets in the long edges therein once the latter has been deposited.

13 Claims, 5 Drawing Sheets

GATHER-STITCHER MACHINE AND METHOD FOR PRODUCING A HEADER INDEX FOR PRINT MATERIALS OF PAPERS WHICH ARE FILED BY MEANS OF A GATHER-STITCHER MACHINE

The invention relates to a gather-stitcher machine for joining and binding, or rather stapling, a plurality of stacked sheets of a printed or other publication, especially a magazine, comprising a transport mechanism and feeder guide mechanisms for placement of the stacked sheets onto the transport mechanism. The invention is also directed at a method for producing a thumb-tab index on printed or other volumes that are to be bound, or rather stapled, by means of a gather-stitcher machine, and in particular for producing a thumb-tab index on magazines.

It is known to provide printed volumes such as, for example, pocket calendars, lexicons, address books or the like with a thumb-tab index, which is normally arranged along the open long side of the bound volume and makes it possible to quickly open the calendar, lexicon, or the like, at an exact page. For this purpose the user of the publication can place a finger in a punched-out index tab portion along the long edge of the individual pages; upon then flipping open the volume all the pages lying to the rear of the finger are held back by the latter, while the remaining sheets which are provided with the punched-out portion are able to flip past the finger. This means that an alphabetically arranged lexicon or address book can easily be opened at the first page of any given letter of the alphabet; calendars can quickly be flipped open at the correct place, according to days of the week or to months.

In the past it has only been possible to produce such thumb-tab indexes at great expense and in a very labour-intensive manner, especially in the case of stitched volumes, as the punched-out portions cannot be produced in the individual stacked sheets, which have been joined together and stapled by a gather-stitcher, until said stacked sheets have been deposited on the transport mechanism of the gather-stitcher machine. The reason for this is that the individual stacks of sheets, which usually contain between four and one hundred pages of what will form the printed volume, but which may also consist of a single signature (section), have to be opened by feeder guide mechanisms parallel to their central stitching crease in order that they can reliably be deposited onto the gathering line or the inverted V-guide of the transport mechanism. To this end, however, it is necessary for grippers incorporated on the feeder guide devices to be able to grasp the stacks of sheets along the entire length of their long edges, something which cannot be guaranteed in cases where index tab portions have already been punched out.

Therefore it has not so far been possible to use a machine to provide punched-out portions for a thumb-tab index on printed or other volumes held together by means of staples along the crease forming the stapled spine, and instead the volumes, once they have been stapled together, have to be opened at the correct place by hand and deposited onto a punching mechanism by means of which the punched-out portions can then be produced. Using this procedure even an experienced worker is scarcely able to produce more than one hundred copies of an edition that is to be equipped with merely a weekly index.

As a consequence of the above-outlined, previously usual method of producing a thumb-tab index on stapled printed or other publications, the latter are disproportionately expensive to manufacture and are limited to small production runs. Up till now it has not been economically viable to give publications involving large production runs and a comparatively low selling price, for instance in particular TV programme guides or the like, a thumb-tab index incorporating punched-out portions arranged one above the other in a relatively narrow zone along the open long edge of the stapled magazine or the like, in order to make it possible to open the magazine at the particular desired weekday. In order, nevertheless, to enable even these publications which are produced in large quantities and very quickly at a low price to be flipped open quickly, the proposal has been made to vary from day to day the width of the pages for the individual days of the week of a television guide and to staple the pages of varying widths one in front of the other in such a way that the first day of the week appearing in the programme guide has the smallest page width and the last day the greatest page width. However, in the case of such an arrangement, particularly where a large number of individual indexes is concerned, as for example in the case of a magazine guide that covers a period of a fortnight, a great deal of space is taken up on the pages of the first days of the index.

It is the object of this invention to create a gather-stitcher machine permitting automated production of a thumb-tab index on printed or other publications intended to be held together by stapling them, in particular magazines. The invention is also aimed at providing a method for automated production of a thumb-tab index on printed or other publications that are to be assembled using a gather-stitcher machine.

Using a gather-stitcher machine of the type mentioned in the introduction, this object is achieved by the fact that it incorporates at least one edge punching device arranged behind a feeder guide device in the transport mechanism's direction of travel. Under the method according to the invention, in the case of such a gather-stitcher machine first of all a sheet stack consisting. of at least a single signature (section) is placed onto a transfer and/or processing mechanism of the gather-stitcher and then at not less than one long edge of the sheet stack first punched-out portions are made by means of the edge punching device arranged to the rear of the sheet stack placement point in the direction in which the transport mechanism advances. Next a further sheet stack is deposited onto the sheet stack previously equipped with punched-out portions and resting on the transport mechanism, thereby producing further punched-out portions which involve only the signatures of the additional sheet stack, these punched-out portions being offset in the longitudinal direction of the stack with respect to the punched-out portions in the stack of sheets underneath. This step of the process is then repeated until the desired number of index tabs has been made in the magazine or the like, after which the publication can then be finished by depositing further unpunched sheet stacks and/or stapling together the stacks which lie one above the other.

Therefore under the invention the per se known gather-stitcher machine, as has already long been standard practice in the manufacture of stapled magazines produced in large runs, has been extended to incorporate a function whereby in addition to the hitherto familiar machine units it is equipped with at least one edge punching device by which the individual punched-out portions are made on the stacks of sheets which are deposited in turn one on top of the other onto the transport mechanism.

The transport mechanism preferably consists essentially of a transfer and gathering line and/or an inverted V-shaped gatherer with driving dogs for the stacks of sheets. A particularly practical form of embodiment of the gather-stitching machine according to the invention results if an edge punching device is allocated to each of a plurality of feeder guide mechanisms. In this arrangement the individual sheet stacks to be given punched-out portions are therefore processed by different edge punching devices, with the result that the punching tools do not need to be set up each time for every new sheet stack, since each punching device always produces punched-out portions at exactly the same location.

The edge punching device preferably has punching tools and a stack guiding unit arranged ahead of the punches in the direction of travel. The stack guiding unit sees to it that the sheet stacks are guided accurately to the punches, with the result that their long edges always pass exactly into the correct position beneath and between the punches, which means that the punched-out portions are also always produced at the same, desired location. The stack guiding unit may consist essentially of at least one sheet marshalling arrangement which leads the edge regions of the sheet stack to the punches, said arrangement opening the sheet stacks suspended by their stapling crease over the inverted V of the gatherer or the gathering line of the transport mechanism and lifting them in the vicinity of the outer long edges, with the result that the leaves of the sheet stack are punched not whilst suspended, but in a substantially horizontal position. So that during the punching operation the sheet stacks are not raised from the transport mechanism or the stack guiding unit and the individual leaves of any sheet stack cannot also become displaced against one another, there is preferably allocated to the stack guiding unit a sheet retaining device which holds the individual sheets of a sheet stack safely on one another. One sheet retention device with particularly low susceptibility to malfunctioning may for example consist essentially of a pressure roller arrangement acting on the sheet stack and/or of an upper and lower belt guide, between which runs the sheet stack that is to be punched.

The punching tools of the edge punching device are preferably arranged on at least one punching table which is aligned parallel to the direction in which the sheet stack travels and which supports the sheet stack in the area of one of its long edges; in the area of their long external edges the punching table forms a firm support for the pages of the stack of sheets being processed, thereby ensuring that all the sheets of the stack are punched through cleanly. It is especially advantageous if to either side of the transport mechanism the edge punching device features a respective punching table, with associated punches, to support the sheet stacks in the area of their long edges, for then the sheets of the sheet stack can simultaneously be punched on both outer edges with punched-out portions which for producing the thumb-tab index are not normally situated at the same point of the long edges, but offset with respect to one another.

Ideally the punching tools are arranged so as to be adjustable in the direction of travel and/or transversely to the direction of travel of the stacks of sheets. This makes it possible to alter the position of the intended punched-out portion longitudinally and/or transversely to the longitudinal direction of a sheet stack as it travels through and thus to produce different indexes in printed or other publications.

Naturally the blades of the punching tool may also be designed to be interchangeable, thereby enabling punched-out portions with different cross-sections to be produced, for example punched-out portions with a semi-circular cross-section, rectangular cross-section, etc.

It is especially advantageous if the punching tools consist essentially of at least one punching roller adapted to be driven in rotation, thereby producing very clean punched sections in the sheet stacks as they pass through. Preferably the punches have a drive adapted to be synchronised at the rate of travel of the transport mechanism, with the result that fluctuations in the rate of travel of the transport mechanism have no effect on the position of the punched-out portions produced using a punching device.

It is particularly advantageous if the gather-stitcher machine features a shroud which is arranged behind the edge punching device in the direction of travel and which at least partially covers the transport mechanism and the sheet stacks being conveyed by it. After the punched-out portions have been made in a first sheet stack, the latter is then moved on by the transport mechanism and arrives beneath the shroud, with the result that a subsequently deposited, additional sheet stack is deposited not straight onto the first stack, but onto the shroud above it. This makes it particularly easy to make the next punched-out portions merely in the signatures of the second sheet stack, since there is no possibility of the individual sheets of the first sheet stack beneath the shroud also being able to get into the punches for the second sheet stack. It is particularly advantageous if the shroud for a first sheet stack merges into a sheet marshalling arrangement for a following sheet stack, thereby resulting in a particularly simple engineering design configuration.

It is preferred if the gather-stitcher machine incorporates an underpressure device which is assigned to the stack guiding unit, the punching table and/or the sheet marshalling arrangement and which sees to it that the sheets of the individual stacks of sheets cannot lift away from these components, but are sucked against them on account of the vacum which prevails.

Further features and advantages of the invention can be taken from the Claims and from the following description and drawing, in which one preferred embodiment of the invention is elucidated by means of an example and wherein:

Figure 1:
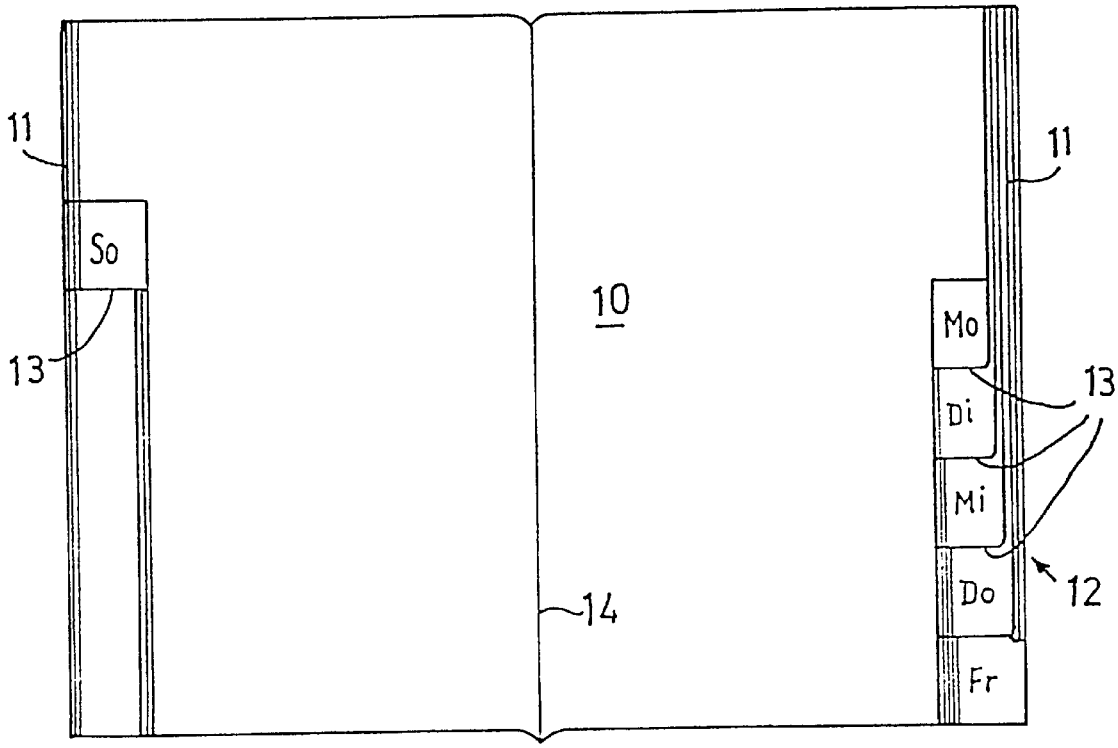
FIG. 1 shows a magazine with a thumb-tab index in the opened state, said magazine having been produced using the gather-stitcher machine according to the invention and by the method of the invention.
Figure 2:
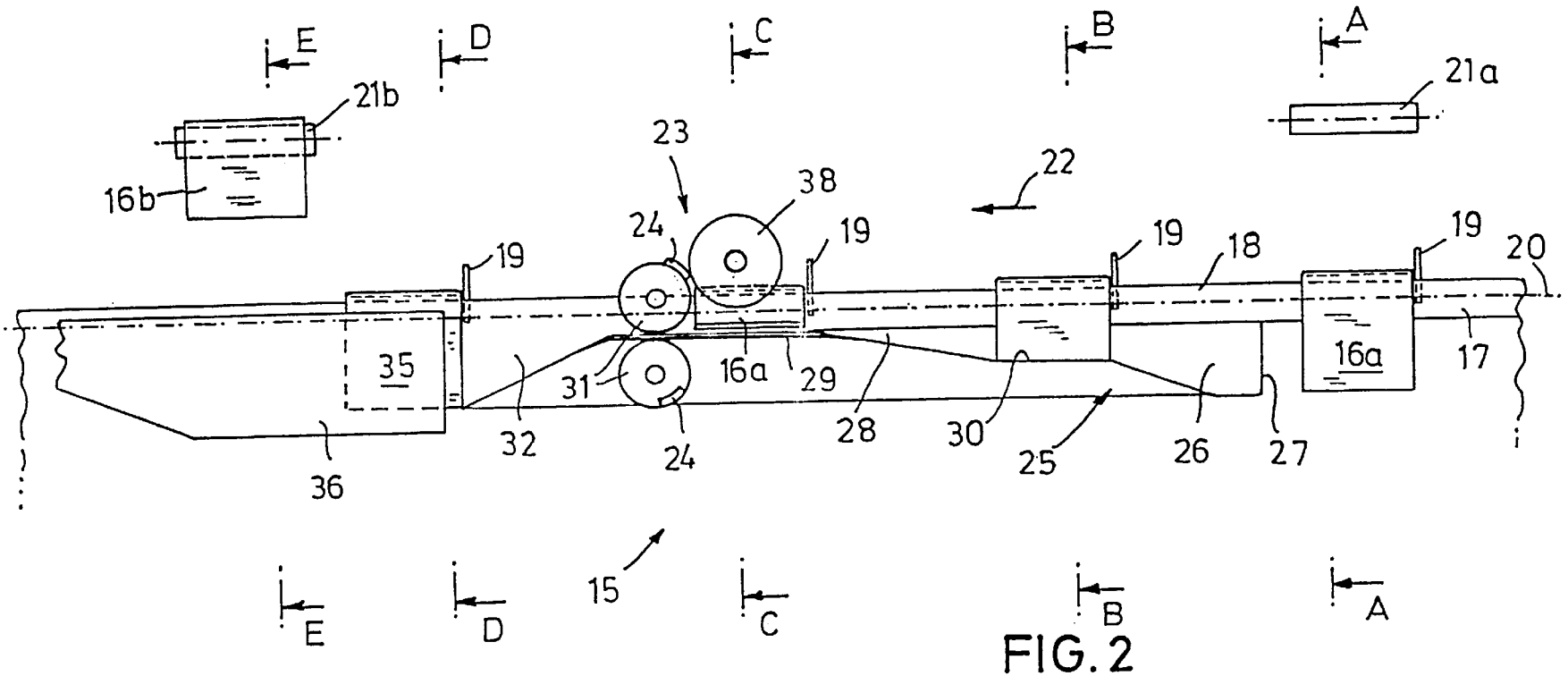
FIG. 2 is a highly schematic side view of a section of a gather-stitcher machine according to the invention.
Figure 3A:
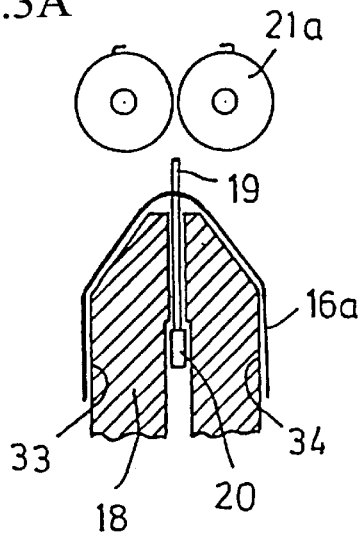
Figure 3B:
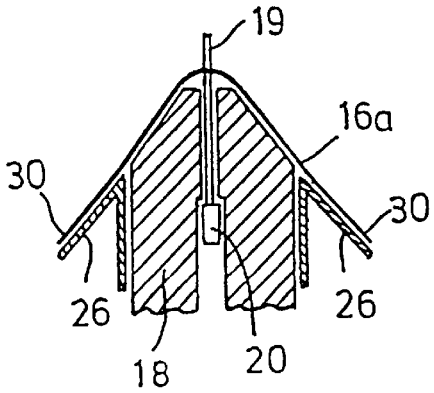
Figure 3C:
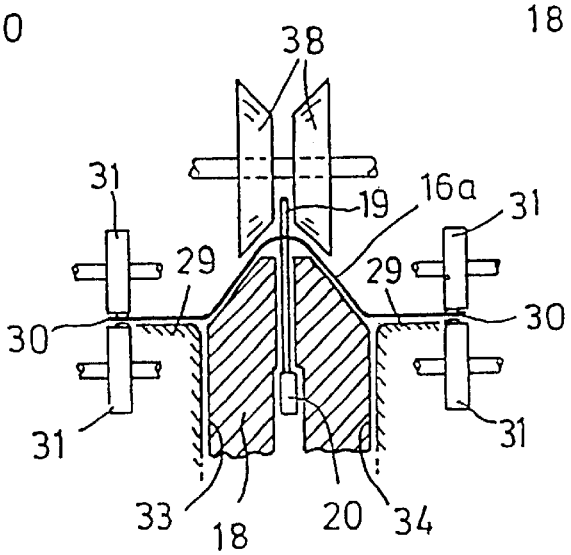
Figure 3D:
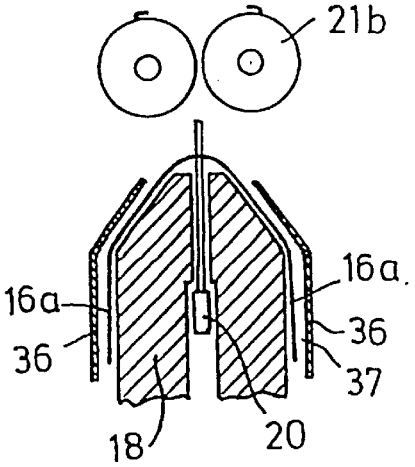
Figure 3E:
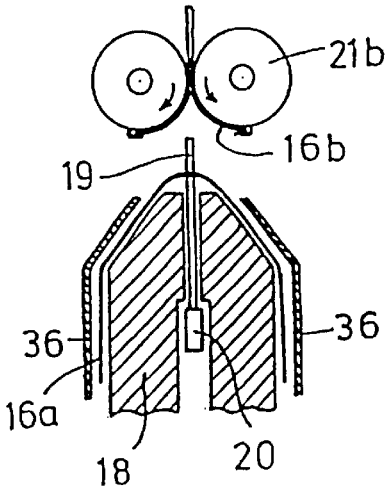
Figure 3F:
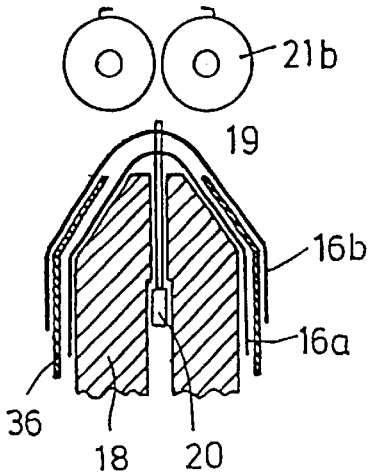
Figure 3G:
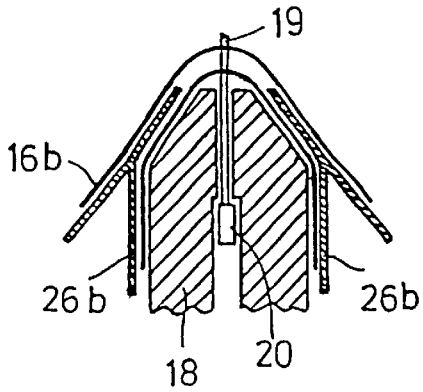
Figure 3H:
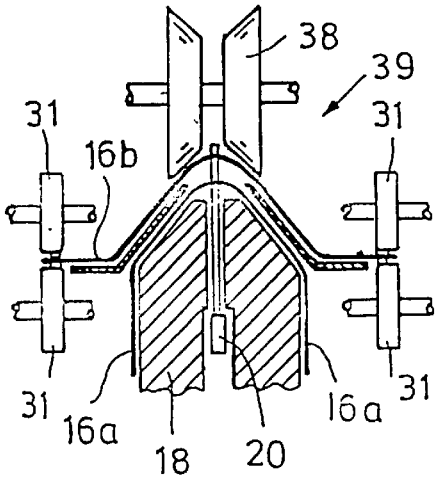
Figure 3I:
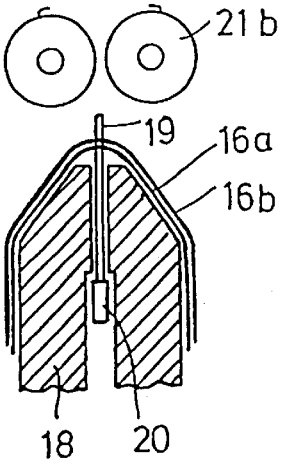
Figure 3J:
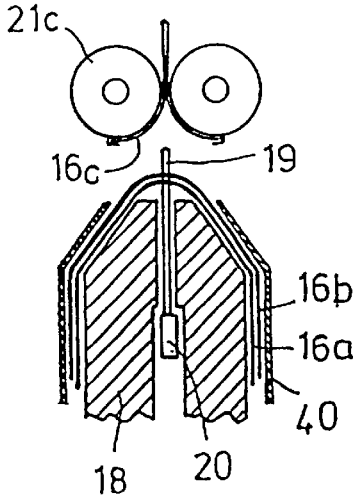
Figure 4:
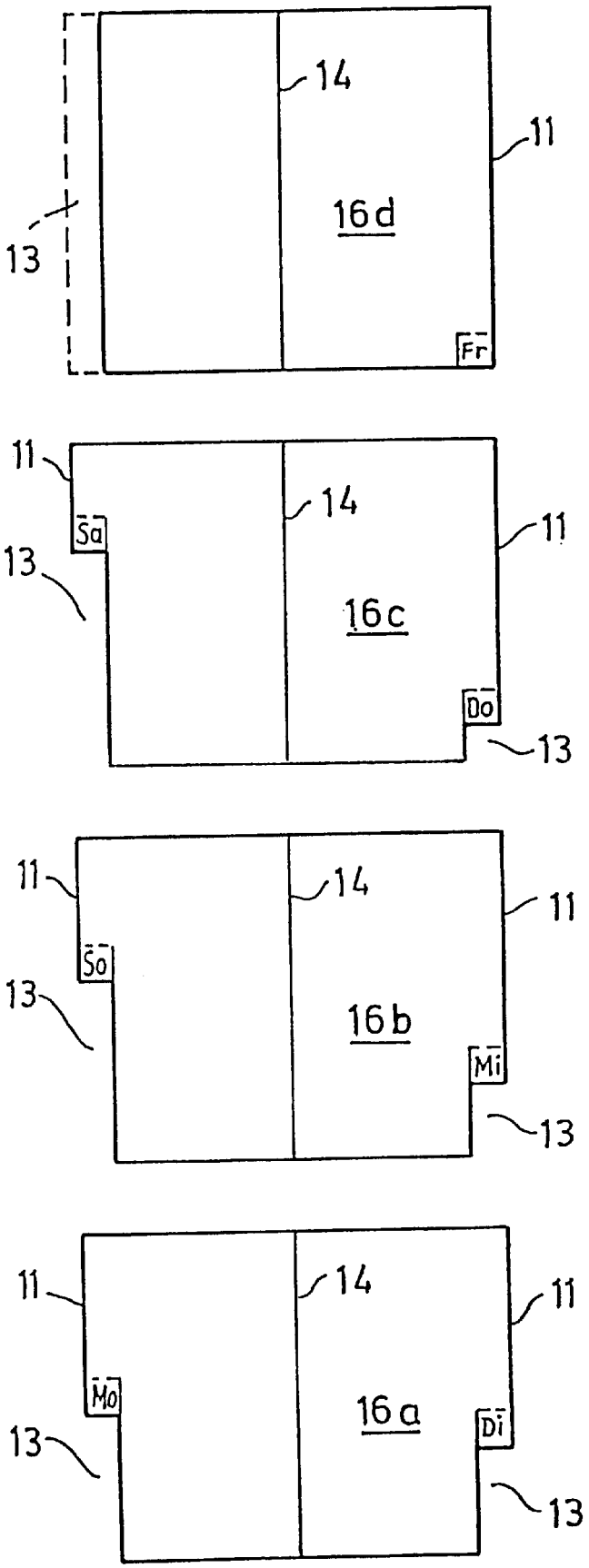

FIGS. 3*a–k* are schematic views depicting the process steps carried out when implementing the method of the invention, seen at right angles to the direction of travel of the gather-stitcher machine and partly in cross-section along the lines A—A to E—E in FIG. 2; and FIG. 4 shows a product structure of the sheet stack forming the thumb-tab index and stapled together in a magazine as seen in FIG. 1.

In FIG. 1, 10 designates a magazine guide for television or radio programmes, in which the times at which the various programmes are being transmitted are indicated for one week on a plurality of pages in each case. In order to make it easier for the reader of the magazine guide to open the guide at a particular day, in the area of its outer long edges 11 the magazine is provided with a thumb-tab index 12 for the days of the week, to which end the pages of the magazine incorporate punched-out portions 13 of varying length for each day of the week.

The magazine 10 depicted in FIG. 1 is bound at its central crease 14 by means of a gather-stitcher machine, once the individual sheet stacks, also designated as products, are merged together for the finished magazine by means of a gathering and transport mechanism belonging to the gather-stitcher machine.

FIG. 2 is a schematised view showing part of a gather-stitcher machine 15, of the type for example used for joining and stapling the individual sheet stacks 16 of the magazine 10. In a per se known manner the gather-stitcher 15 has a transport mechanism 17 with an inverted V-shaped gatherer 18, from which driving fingers 19 protrude upwardly which are arranged on a revolving transfer and gathering line 20 arranged inside the gatherer 18. Each sheet stack 16 of the magazine guide 10 being provided is equipped with its own feeder guide mechanism 21, and in FIG. 2 only feeder guide mechanisms 21*a,* 21*b* for two different sheet stacks are indicated. However, it goes without saying that to produce the entire magazine more than two sheet stacks are laid one over the other on the gather-stitcher and stapled together, and that more feeder guide mechanisms are correspondingly also provided in the machine. As will be outlined below, the magazine in the exemplifying embodiment described herein consists of at least four sheet stacks or individual products, each with at least two signatures, in order to produce the thumb-tab index apparent in FIG. 1.

As can be seen from FIG. 2, in the arrowed (22) direction of travel of the sheet stacks deposited on the inverted-V gatherer 18, behind the feeder guide mechanism 21*a* the gather-stitcher machine 15 features an edge punching device 23, with the help of which are made the punched-out portions 13 which will be produced in the first sheet stack 16*a* deposited by the feeder guide mechanism 21*a*. Such an edge punching device is also allocated to the next feeder guide mechanism 21*b* for the second sheet stack 16*b* to be deposited, as well as at least one further feeder guide mechanism, though these are not depicted in FIG. 2.

The edge punching device 23 features punching tools 24 which are assigned to the long edges 11 of the stack of sheets 16*a,* and also a stack guiding unit 25 which is arranged ahead of the punching tools and which essentially consists of two sheet marshalling plates 26 arranged on either side of the inverted V-shaped gatherer 18. The sheet marshalling plates 26 are situated immediately to the rear of the feeder guide mechanism 21*a,* with their leading edges 27 resting flush against the inverted V-shaped gatherer 18, before thence protruding in the direction of travel 22 by an increasingly large angle from the gatherer, so that as it travels along the gatherer the stack of sheets 16*a* is raised by its long edges 11 from the original position in which it hangs down from the gatherer. At their back end 28 the sheet marshalling plates merge into a punching table 29 which extends horizontally on both sides of the gatherer 18 and on the two outer edges 30 of which are disposed the punching tools which are constructed in the form of punching rollers 31.

To the rear of the punching table in the direction of travel, the latter is adjoined by return plates 32 which, once the stack has passed through the punching device, allow the stack of sheets to slide back into its original position on the gatherer, in which position the sheets of the stack hang more or less vertically downwards. Disposed to the rear of the return plates 32 is a shroud 35 which covers the gatherer 18 on both its outer sides 33, 34 and which consists of two cover plates 36 adapted to the contour of the gatherer and which are arranged at a distance from the gatherer 18 in such a way that the laterally suspended leaves of the sheet stack which has previously been guided through the edge punching device 23 pass into the gap formed between the cover plates 36 and the gatherer 18. However, the arrangement is so designed that the stack of sheets 16*a* is not covered by the plates of the shroud 35 in the area of its central crease 14 which rests on top of the gatherer 18, and therefore protrudes upwards out of the shroud 35 along with the driving finger 19 which conveys the stack onward. The shroud starts before the following feeder guide mechanism 21*b* in the direction of travel 22 of the transport mechanism 17 and to the rear of the latter merges into sheet marshalling plates 26*b* which are configured to the rear of the first feeder guide mechanism 21*a* in accordance with the sheet marshalling plates 26*a*.

FIGS. 3*a* to 3*k* provides the best explanation of how the gather-stitcher machine described above can be used to machine-manufacture the thumb-tab index 12 on the magazine 10 in implementation of the method according to the invention.

To this end, in a first step of the method a first stack of sheets 16*a* is placed on the gatherer 18 by means of the first feeder guide mechanism 21*a;* one of the driving fingers 19 circulating with the gathering line 20 places itself against the rear edge of the stack 16*a,* in the area of the central crease 14 thereof, and in this manner conveys the stack of sheets 16*a* lying on the gatherer onward in the direction of the edge punching device 23 which is disposed behind said stack in the direction of travel. The outer edges 30 of the sheet stack are raised with the help of the sheet marshalling plates 26 from the suspended position represented in FIG. 3*a* (FIG. 3*b*) and so pass into a substantially horizontal position in which they rest on the punching tables 29 of the first edge punching device 23. In the edge punching device the stack of sheets 16*a* is held pressed from above against the gatherer by a pressure roller arrangement 38 disposed in the area of the stack's central crease, thereby preventing it from lifting away from the latter and causing its outer edges 30 to pass exactly between the punching rollers 31 disposed externally on the punching tables 29 and to either side of the gatherer. With the help of the punching rollers 31 the punched-out portions 12 of the first stack of sheets 16*a* are made on the two outer edges of said stack. This step of the method is depicted in FIG. 3*c*.

As the first stack of sheets continues on its way, it slides over the return plates 32 and thus arrives back at its original position suspended on the gatherer, before passing beneath the cover plates 36 of the shroud 35 into the gap 37 formed between said shroud and the gatherer 18 (FIG. 3*d*). The following feeder guide mechanism 21*b* is next used to deposit the second stack of sheets 16*b* on the same driving finger 19 onto the transport mechanism 17; the shroud 35 sees to it that the sheets of the second stack of sheets 16*b* are kept separate from the first stack of sheets 16*a* in the region of their outer edges and thus although the two stacks of sheets are guided with the same driving finger onward in the transport mechanism, the second stack of sheets 16*b* can nevertheless be raised separately from the first stack of sheets 16*a* in the region of its outer edges (FIGS. 3*e, f*). The outer edges of the second stack of sheets are raised in the same manner as earlier in the case of the first stack of sheets with sheet marshalling plates 26*b,* which merge into a punching table of a second edge punching device 39 in which the punched-out portions on the second stack of sheets are made, whilst the first stack of sheets is simultaneously also being conveyed beneath the shroud 35 without being able to pass into the tools of the second edge punching device 39. The shroud 35 terminates with the punching table of the second edge punching device 39, thereby enabling the second stack of sheets to lay itself fully against the first stack of sheets once the punched-out portions have been made in it, and to be joined to said first stack to produce a double stack. As soon as both stacks of sheets 16*a, b* are situated on top of one another, they pass beneath cover plates 36 of a further shroud 40 onto which a further stack of sheets 16*c* is then deposited with the help of a further feeder guide mechanism 21*c* and upon travelling onward through the machine is processed by a further edge punching device, in the manner described earlier.

Once the punched-out portions have been made, in the manner outlined, in the stacks of sheets forming the index, additional stacks and/or a coverleaf with no punched-out portions can be placed on the product thus joined together, prior to the magazine thus assembled being stapled and then cut to size in the conventional way.

The punching tools of the individual edge punching devices 23 are arranged in an adjustable manner on said devices and can be finely adjusted both in the direction of travel and at a right angle thereto, thereby enabling the position, length, width and/or even the geometrical shape of the punched-out portions to be varied. The punching tools, or rather the drive thereof, are synchronised with the drive of the transport mechanism 17 via a so-called virtual shaft, so that it is ensured that the punched-out portions are always made at exactly the same, correct place in the respective stacks of sheets.

FIG. 4 shows the product structure for the thumb-tab index provided in the TV programme guide 10. Accordingly the first three stacks of sheets 16*a–c* feature punched-out portions 13 on both outer edges 30 after they have travelled through the respective edge punching device, and all the punched-out portions are of different lengths in order to allow the index to be formed after the individual stacks have been joined together.

The fourth, final stack of sheets 16d to be deposited has no punched-out portion on the right-hand half of its sheets, whereas the left-hand half of its sheets is trimmed along its outer edge 30 throughout its height and thus after placement onto the first stacks of sheets the left-hand half of the sheets of the fourth stack of sheets 16*d* forms the first section of the thumb-tab index 12.

The invention is not confined to the example of embodiment depicted and described herein, but also includes many modifications and additions without departing from the scope of the invention. For example, the punched-out portions made with the help of the punching device do not necessarily have the rectangular configuration depicted, nor is it necessary for the punched-out portions to always extend as far as the lower edge of the stacks of sheets. It would for instance be feasible to produce substantially semi-circular punched-out portions at the edges of the stacks of sheets, with the punched holes being mutually offset from one another in different stacks. The invention can of course also be used to produce indexes with more divisions, for example alphabetical indexes in address books or the like, in which case it will be necessary to increase the number of feeder guide mechanisms and edge punching devices correspondingly.

What is claimed is:

1. A gather-stitcher machine for joining stacks of sheets of a printed or other publication, the gather-stitcher machine comprising:

a transport mechanism;

feeder guide mechanisms for depositing stacks of sheets onto said transport mechanism; and an edge punching device disposed to the rear of at least one of said feeder guide mechanisms in the direction of travel of said transport mechanism, wherein said edge punching device includes punching tools and a stack guiding unit arranged before said edge punching tools in the direction of travel of said transport mechanism, and wherein said stack guiding unit includes at least one sheet marshalling arrangement that guides edge regions of the stacks of sheets to said punching tools.

2. The gather-stitcher machine according to claim 1, wherein said stack guiding unit includes a sheet holding device.

3. The gather-stitcher machine according to claim 2, wherein said sheet holding device includes a pressure roller arrangement that operates on at least one of the stacks of sheets and/or on an upper and lower belt guide.

4. The gather-stitcher machine according to claim 3, wherein said edge punching tools are disposed on at least one punching table aligned parallel to the direction of travel of said transport mechanism.

5. The gather-stitcher machine according to claim 4, wherein said edge punching device includes a punching table on either side of said transport mechanism with associated punching tools, said punching table supports at least one of the stacks of the sheets in an area of their long edges.

6. The gather-stitcher machine according to claim 5, wherein said punching table includes an underpressure device.

7. The gather-stitcher machine according to claim 1, wherein said at least one sheet marshalling arrangement includes an underpressure device.

8. A gather-stitcher machine for joining stacks of sheets of a printed or other publication, the gather-stitcher machine comprising:

a transport mechanism;

feeder guide mechanisms for depositing stacks of sheets onto said transport mechanism; and an edge punching device disposed to the rear of at least one of said feeder guide mechanisms in the direction of travel of said transport mechanism, wherein said edge punching device includes a punching table on either side of said transport mechanism with associated punching tools, said punching table supports at least one of the stacks of sheets in an area of their long edges, wherein said punching tools are arranged so as to be adjustable in the direction of travel and/or at a right angle to the direction of travel of said transport mechanism, wherein said punching tools include at least one rotary-driven punching roller, wherein said punching tools include a drive that can be synchronized at the traveling speed of the transport mechanism;

a shroud arranged to the rear of said edge punching device in the direction of travel of said transport mechanism, and at least partly covering said transport mechanism, wherein said shroud merges into a sheet marshalling arrangement.

9. The gather-stitcher machine according to claim 8, wherein said stack guiding unit, said punching table or said at least one sheet marshalling arrangement is provided with an underpressure device.

10. The gather-stitcher machine according to claim 9, wherein said sheet marshalling arrangement of said guiding unit merges into said punching table of said edge punching device.

11. A method for producing a thumb-tab index on printed or other publications that are to be bound by a gather-stitcher machine, the method comprising:

depositing a first stack of sheets consisting of at least a single signature onto a transfer and processing mechanism of the gather-stitcher machine;

producing first punched-out portions on at least one long edge of the first stack of sheets with an edge punching device arranged to the rear of a deposition point of a second stack of sheets in the conveying direction of the transport mechanism;

depositing a second stack of sheets onto the first stack of sheets earlier provided with punched-out portions and lying on the transport mechanism, and producing additional punched-out portions on signatures of the second stack of sheets which additional punched-out portions are offset in the longitudinal direction of the stacks with respect to the punched-out portions in the first stack of sheets; and stapling together the stacks lying on top of one another.

12. The method according to claim 11, wherein the second stack of sheets is deposited onto the first stack of sheets interposing a shroud therebetween.

13. The method according to claim 11, including raising the first stack of sheets at least in the region of their long edges from a suspended, substantially vertical position before producing the first punched-out portions.

* * * * *